US005167720A

United States Patent [19]

Diamond et al.

[11] Patent Number: 5,167,720

[45] Date of Patent: Dec. 1, 1992

[54] HIGH PRESSURE WATER TREATMENT METHOD

[75] Inventors: Edward M. Diamond, Ellenwood; David M. Free; Richard H. Keene, both of Fayetteville, all of Ga.

[73] Assignee: Northwest Airlines, Inc., Eagan, Minn.

[21] Appl. No.: 680,680

[22] Filed: Apr. 3, 1991

[51] Int. Cl.[5] ..... B08B 3/02

[52] U.S. Cl. ..... 134/25.4; 134/34; 134/144; 134/172

[58] Field of Search ..... 134/25.4, 34, 144, 172

[56] References Cited

U.S. PATENT DOCUMENTS 3,546,084 5/1969 Dohogne et al. ..... 204/129.35
3,877,643 4/1975 Smith et al. ..... 239/754

FOREIGN PATENT DOCUMENTS 02211 5/1985 PCT Int'l Appl. .

*Primary Examiner*—Theodore Morris

*Assistant Examiner*—Zeinab El-Arini

*Attorney, Agent, or Firm*—Dorsey & Whitney

[57] ABSTRACT

The present invention provides an apparatus and method for treating jet engine components with high pressure water. The apparatus of the present invention broadly consists of a generally enclosed room-size chamber, a water delivery means, including a nozzle body having multiple water emitting orifices, a support frame and gantry for supporting the water delivery means whereby the water delivery means is movable along multiple axes, a workpiece supporting turntable and a computer or microprocessor for controlling the operational parameters of the apparatus. Additionally, the present invention provides a method for using the apparatus to blast jet engine components with high pressure water without added chemical or particulate abrasives, the operational parameters of the apparatus being selected from a range of such parameters. The water is directed against the component under very high pressure to remove coatings or deposits or to machine the component.

3 Claims, 14 Drawing Sheets

| Fig. 9b-1 | Fig. 9b-2 |
|---|---|

HIGH PRESSURE WATER TREATMENT METHOD

TECHNICAL FIELD

The present invention relates to devices and methods for material treatment. In particular it relates to an apparatus and a method for treating jet engine components with high pressure water to remove coatings or deposits.

BACKGROUND OF THE INVENTION

High pressure streams of fluid or fluid entrained abrasive materials have been used for a long time to abrade, cut, shape or clean a wide variety of items. Such usage ranges through sandblasting structures, cutting metal or stone, and cleaning machine elements.

Typically, this technology is used as a gross or initial step in cleaning or reconditioning for at least two reasons. First, entrained particles or chemicals are very abrasive and the surface of the item being treated may be damaged, particularly if the stream of treating material dwells or impinges upon an area of the object for too long. Secondly, because of overspray and the generally harsh nature of the solvents or blastants used, the application must be strictly controlled.

These problems have been addressed partially by developing sealed chambers and gantry-type mechanical or robotic apparatus, some of which may be computer controlled to increase the precision of the treatment. A typical system may include an enclosure, computer or microprocessor control, one or more dispersing nozzles for emitting the blastant material, a gantry-type suspension apparatus for supporting the nozzles, and a workpiece support. In addition to control of nozzle position, the computer also may be used to control the blastant pressure and media flow volume.

The advent of computer control and gantry-type apparatus capable of precision movement has enabled increasingly sophisticated treatment of high tolerance machine parts, for example, rotating and non-rotating components of jet engines. Jet engine components are subject to frequent inspection and, because of high replacement costs, overhaul and reconditioning if warranted. Reconditioning engine components usually involves removing ceramic, metallic, plasma sprayed or flame-sprayed coatings. In the past, the removal of these coatings required chemical treatment or blasting with an abrasive grit and then hand machining.

While the blasting apparatus mentioned above, including computer controlled gantry-type robotic systems, are now used for removing coatings from and machining engine components, and represent improvements in the art, several problems have remained inadequately addressed and additional problems have been generated.

First, it is still difficult to adequately control the operating parameters of high pressure liquid or particle abrasive treatment systems. Secondly, the workpiece still may be easily damaged by the abrasive material or blastant being used. The substrate or parent metal of the engine component being treated may undergo distortion, superficial damage or metal loss, generating residual stress in the components. In many instances, hand finishing is still necessary.

Additional problems include long, expensive set-up and processing time for prior art blasting systems. Existing systems generate severe environmental problems because waste volumes are high, particularly when particulate abrasive material is used. A corollary problem is that the abrasive material must be retrieved, cleaned and disposed of. Prior art systems create a high volume of hazardous waste sludge or require reclamation of chemical or metallic abrasive elements. Aerosol contaminants produced by prior art systems cause severe health and pollution problems, including high noise levels.

Clearly, it would be advantageous if existing, high precision blasting systems for removing coatings from and treating jet engine components could be adapted to use a safe, inert, neutral material such as water. Such a system would address safety, environmental concerns and economic issues. A high pressure material treatment apparatus and method able to use water as the blastant would be a decided improvement over the high pressure blasting devices in the prior art.

SUMMARY OF THE INVENTION

The present invention provides an apparatus and method for treating workpieces, particularly jet engine components, with high pressure water. The apparatus of the present invention broadly consists of the following elements: a generally enclosed, room-size chamber, a water delivery means, including a multiorifice, spinnable nozzle body, a support frame and gantry for supporting the water delivery means whereby the delivery means may be moved along multiple axes, a workpiece supporting turntable, and a computer or microprocessor for controlling the operational parameters of the apparatus. Additionally, the present invention contemplates a method for using the apparatus to blast jet engine components with high pressure water wherein the operational parameters of the apparatus are selected from a range of such parameters, and water is directed against a component under very high pressure to remove coatings or deposits or to machine the component.

A feature of the present invention is the use of water under ultra high pressure, without added chemical or particle abrasive material, to remove coatings from jet engine components.

Additional features of the present invention include a positionable water delivery means including a rotatable nozzle body having multiple water emitting orifices. The nozzle body is rotated to produce a single stream of water having a relatively larger cross-sectional area than the cross-sectional area of a stream of water emitted from any one individual orifice. The water delivery means is positionable so that the angle of incidence of the water stream upon a workpiece may be selected, as can the distance between the nozzle and the workpiece.

An object of the present invention is to provide very high pressure water treatment system and method wherein damage to a workpiece is minimized.

Another object of the present invention is to provide an environmentally safe, ultra-high-pressure water jet material treatment apparatus and method that reduces blastant waste volumes, reduces or eliminates hazardous waste products or sludges, and reduces airborne contaminants and noise levels.

Still another object of the present invention is to provide a ultra high pressure water jet material treatment apparatus and method wherein the operational parameters of the apparatus may be varied within specified ranges depending upon the workpiece to be treated.

Other objects, features and advantages of the present invention will become more fully apparent and understood with reference to the following specification and to the amended drawings and claims.

DETAILED DESCRIPTION OF THE PREFERRED EMBODIMENT

Figure 1:
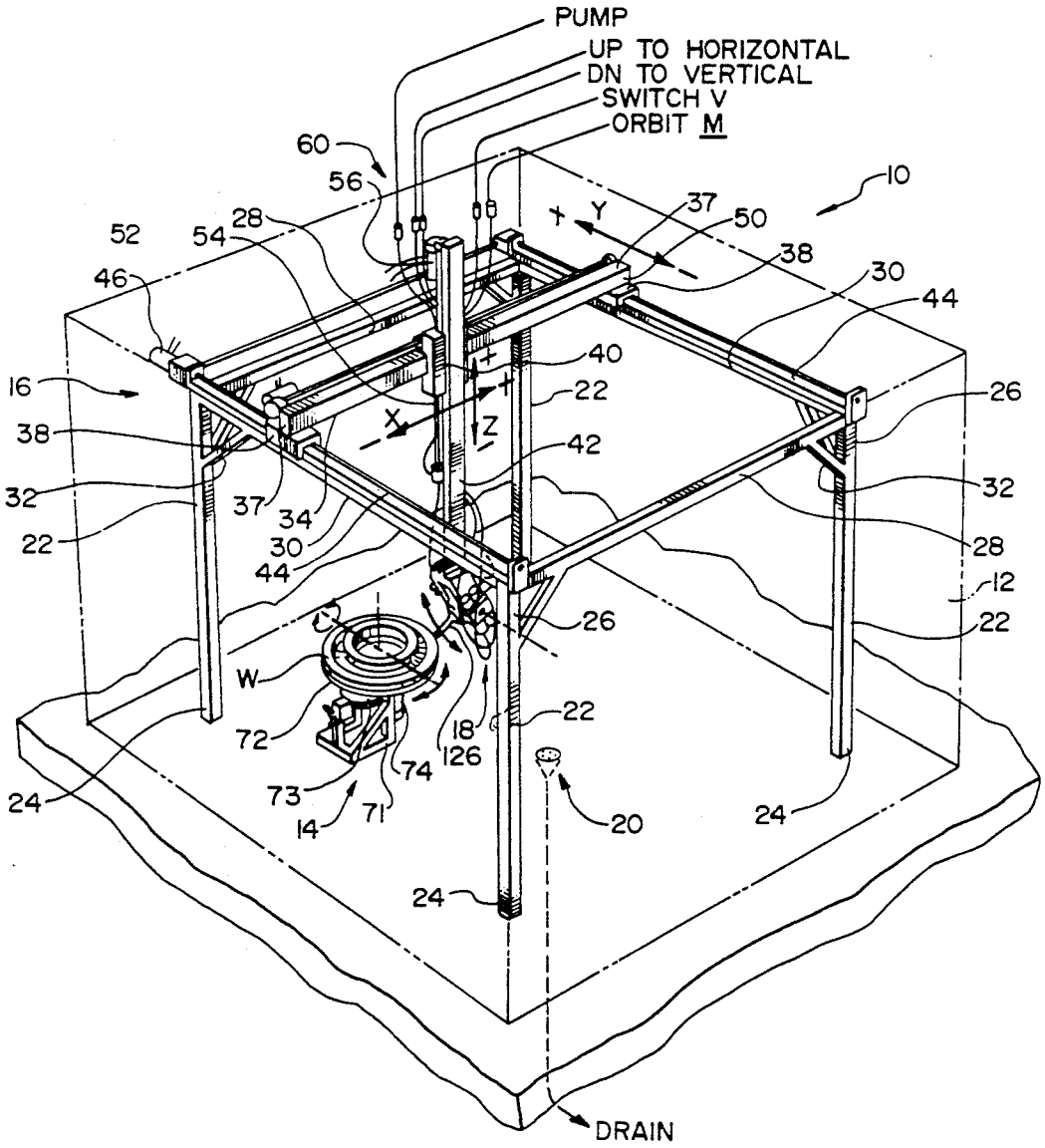
FIG. 1 is a perspective view of the invention, including phantom lines depicting an enclosed chamber within which the invention is disposed, and including arrows depicting the multiple and adjustable movements of the present invention.

Referring to FIG. 1, the high pressure water treatment apparatus 10 of the present invention includes a substantially enclosed spray room chamber 12, a workpiece supporting turntable 14, a support frame 16, and a water delivery means 18, a drain system 20 (partially shown only), and a remote computer or microprocessor control means (not shown). A workpiece W is depicted supported on the turntable 14.

The support frame 16 includes at least four generally vertical columns 22 having a base 24 and an upper end 26. Two opposed generally parallel spreader beams 28 and two generally parallel rail frames 30 are connected to the upper end 26 of the vertical columns 22. Reinforcing diagonal corner members 32 may be provided as necessary.

With further reference to FIG. 1, the support frame 16 supports a gantry carriage having two ends 37 at which it is operably connected to shoes 38. A secondary dual axis carriage 40 is movably mounted on the gantry body 34. A vertical depending member 42 is coupled to the dual axis carriage 40.

As depicted in FIG. 1, the two rail beams 30 are fitted with Y-axis tracks 44. A Y-axis servo-motor 46 is mounted at one end of the Y-axis tracks 44. The gantry body 34 is provided with an X-axis track 50 and an X-axis motor 52 is mounted at one end 37 of the gantry body 34. The vertical member 42 is fitted with a Z-axis track 54 and a Z-axis motor 56 is operably connected thereto at the upper end of the vertical member 42. The depicted tracks may be comprised of rack and pinion or chain and gear systems driven by the respective motors which may be electrically or pneumatically operated. Appropriate pneumatic plumbing and electrical connections, indicated generally at 60, may be provided for each motor.

The workpiece supporting turntable 14 includes a frame 71, a rotatable workpiece table 72, an horizontal pitch adjustor assembly 73, and a turntable drive motor 74.

Figure 3:
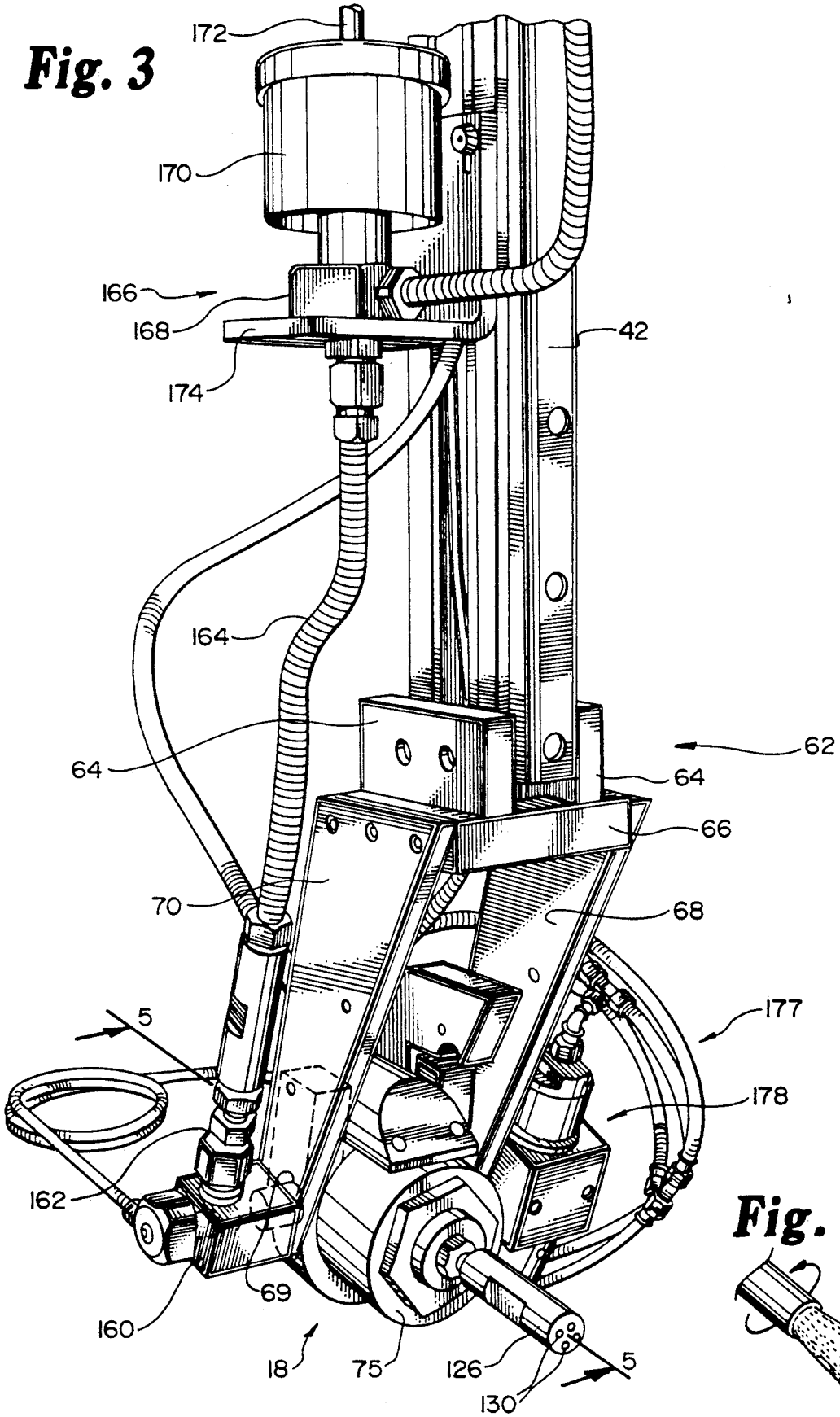
FIG. 3 is a fragmentary, front elevational view depicting the water delivery portion of the present invention, including the nozzle body, in a generally horizontal positon.
Figure 6:
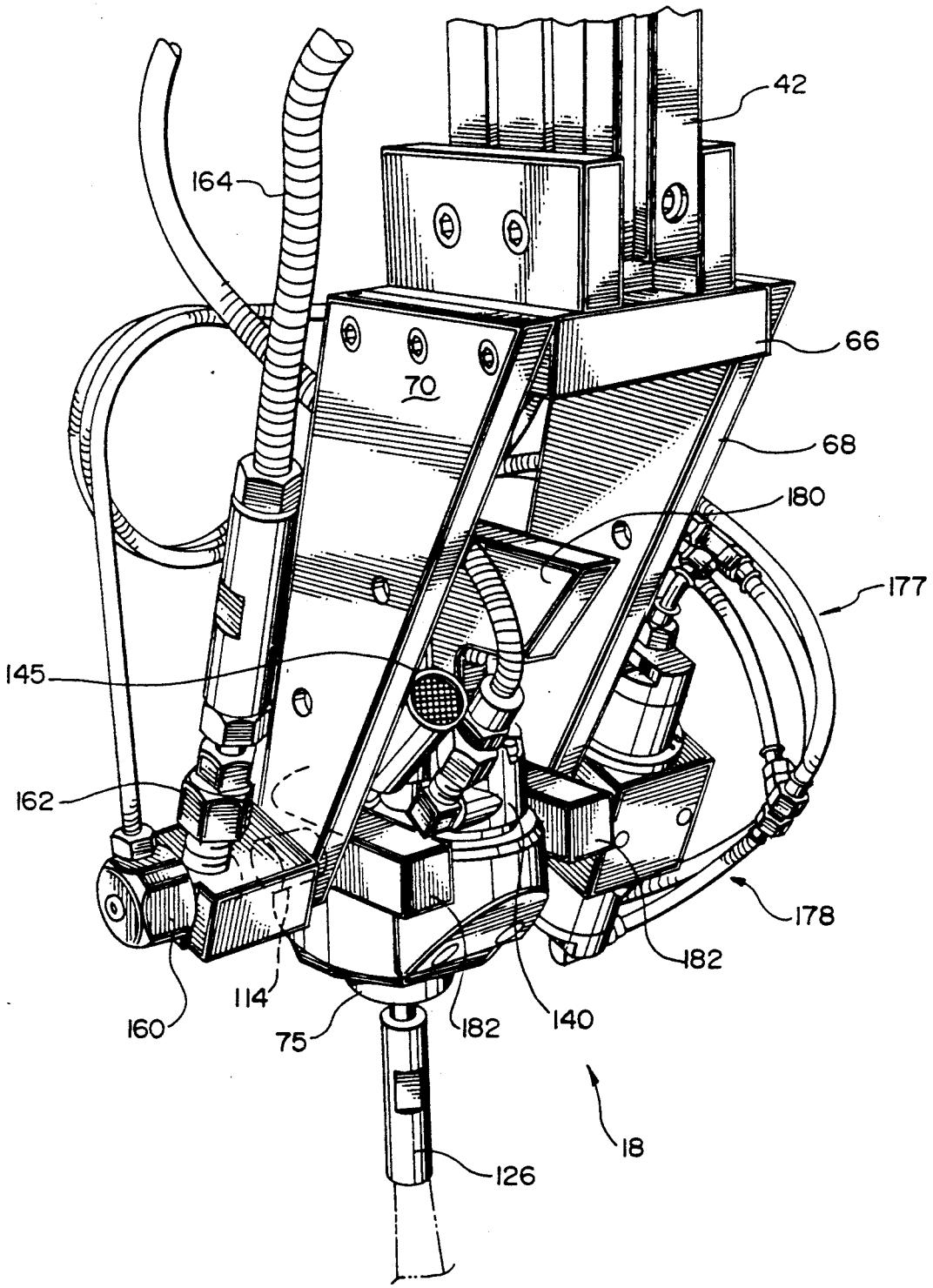
FIG. 6 is a fragmentary perspective view of the present invention, similar to FIG. 3, showing the nozzle body of the present invention repositioned to a generally vertical position.
Figure 7:
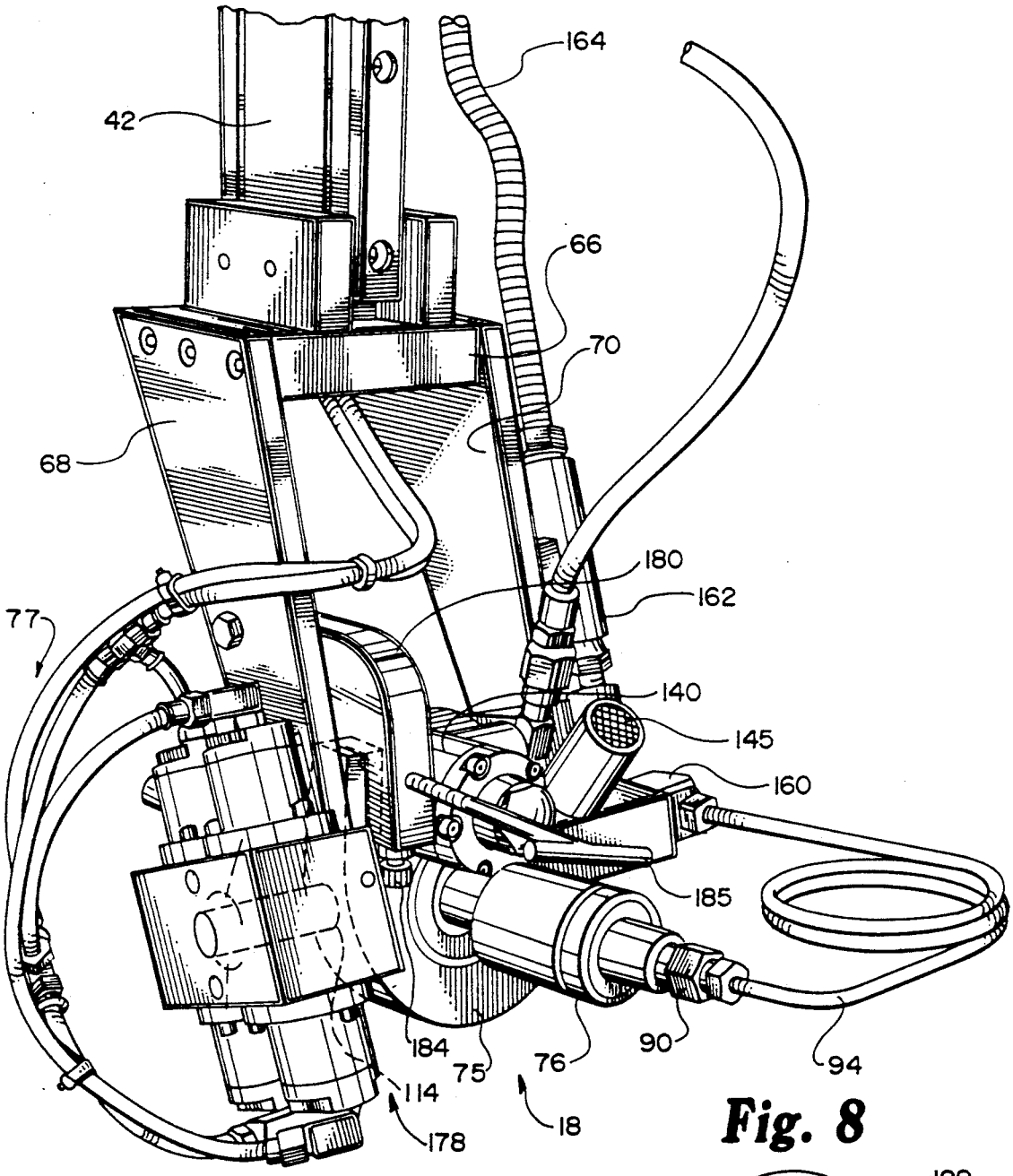
FIG. 7 is a fragmentary perspective view of the present invention from the back side thereof and with the water delivery means in the same position depicted in FIG. 3.

Referring to FIG. 3, the lower end 62 of the vertical member 42 receives yoke mounting blocks 64. A yoke 66 is mounted on the block 64 and includes a rotator side arm 68 and a water side arm 70. Each arm 68, 70 includes an aperture 69 adjacent the distal end. Referring to FIGS. 3, 6 and 7, the high pressure water delivery means 18 is movably mounted between the rotator side arm and the water side arm, 68, 70 respectively, of the fork 66. The water supplied to the high pressure water delivery means 18 may be raised to a suitable pressure by a commercial available water intensifier such as the model 1000 manufactured by Ingersoll-Rand Co. of Baxter Springs, Kans.

Figure 5:
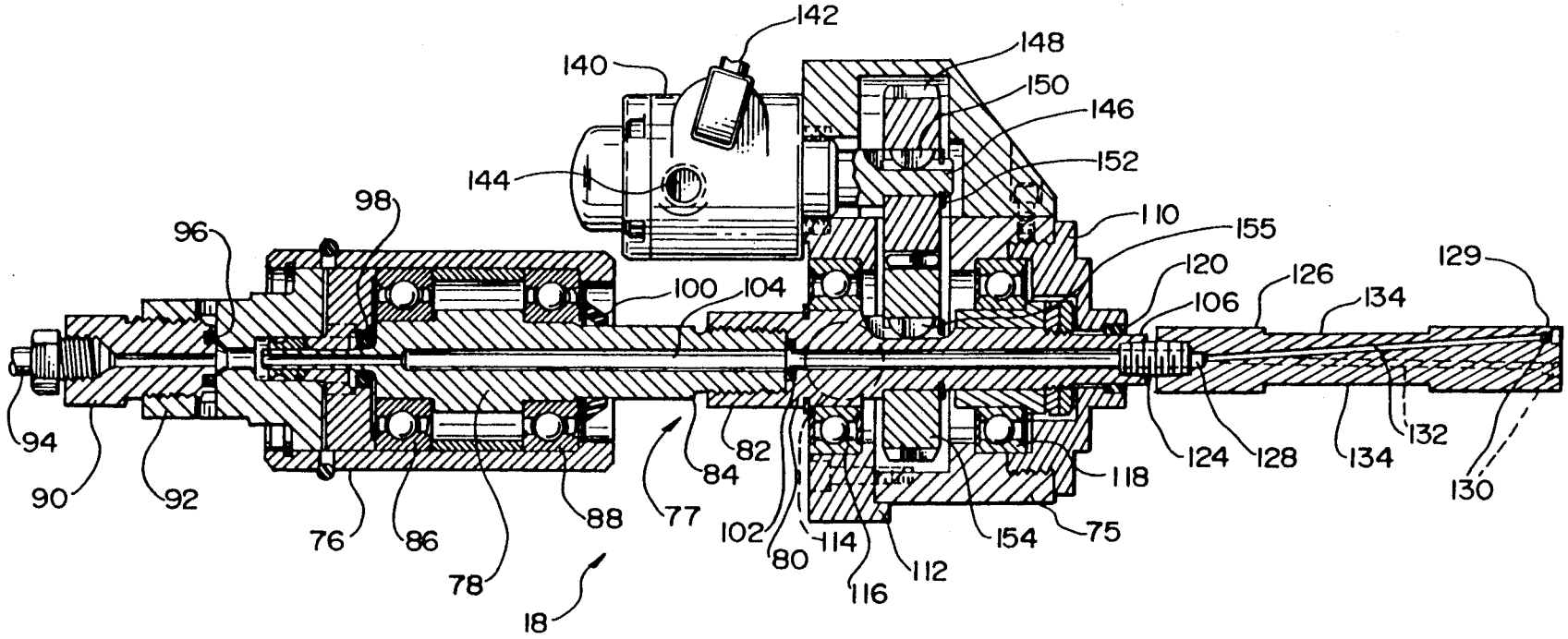
FIG. 5 is a cross-sectional elevational view taken along the line 5—5 in FIG. 3.

Referring to FIG. 5, the water delivery means 18 includes a front housing 75, and a rear high pressure hydraulic swivel housing 76. The rear swivel housing 76 may be similar to the commercially available model 2410 manufactured by Advanced Mining and Construction Systems of Kent, Wash. An elongated spindle 77 extends through the front and rear housings 75, 76. The elongated swivel 77 includes a swivel spindle portion 78 and a nozzle spindle portion 80. The spindle swivel 78 and the nozzle spindle 80 are threadably and generally centrally joined at the rear end 82 of the nozzle spindle 80 and the forward end 84 of the spindle swivel 78. The swivel spindle 78 is rotatably or spinably received in the rear housing 76. A pair of thrust ball-type bearings 86, 88 are mounted within the rear housing 76 to rotatably support the spindle swivel 78. An input fitting 90 is threadably received at the rear end 92 of the rear housing 76. The input fitting 90 is connected to a high pressure water line 94. Appropriate seals 96, 98, 100 are provided as necessary at the rear housing. The seals 96, 98, 100 may be elastomeric or rubber high pressure seals.

The swivel spindle 78 and the nozzle spindle 80 are threadably connected at the front end 84 of the spindle swivel 78 and the rear end 82 of the nozzle spindle 80. Appropriate seals 102 are provided at the junction between the swivel spindle 78 and the nozzle spindle 80. Together the two spindles 78, 80 combine to form an elongated spindle 77 having a generally central high pressure water passage 104 along the generally central elongated axis of the spindle 77. The spindle 77 has a discharge end 106.

The front housing 75 of the water delivery means 18 includes a front cover 110 and a rear cover 112. The rear cover 112 is provided with integral trunnions 114 at each side thereof. The nozzle spindle 80 is supported in the front housing 75 by at least a pair of thrust ball bearings 116, 118. As in the rear housing 76, appropriate elastomeric or rubber seals 120 are provided.

A threaded nipple 124 is mounted at the discharge end 106 of the spindle 77. A nozzle body 126 is mounted on the threaded nipple 124. The nozzle body 126 includes a water inlet 128 and a discharge end 129 with a plurality of water outlet orifices 130. The inlet 128 and the orifices 130 are connected by a plurality of generally longitudinal, straight bores 132 through the nozzle body 126. Generally central flattened areas 134 are provided on the nozzle body 126.

With further reference to FIG. 5, a pneumatic orbit motor 140 is operably mounted on the front housing 75. The orbit motor 140 may be similar to the model IAM-NRV-398 motor, manufactured by Gast of Benton Harbor, Mich. and includes an input port 142 for pressurized air and an exhaust port 144. The exhaust port 144 may be provided with an exhaust manifold 145 (FIG. 6 and 7). An orbit motor output shaft 146 extends into the interior of the front housing 75. An orbit drive gear 148 is connected to the shaft 146 and held in place thereon by a key 150 and snap ring retainer 152. The orbit drive gear 148 drives an orbit driven gear 154 which is fixed by a key 155 to the nozzle spindle portion 80 of the spindle 77.

Referring to FIGS. 6 and 7, the high pressure water line 94 connected to the rear inputting fitting 90 is connected at a second end thereof to an hydraulic swivel fitting 160. The swivel fitting 160 may be similar to the commercially available model 221B, part C5152, manufactured by Flow International Corp. of Kent, Wash. The fitting 160 is connected by conventional high pressure fittings 162 to a high pressure water line 164.

Referring to FIG. 3, a pneumatically operated control valve 166 is interposed along the length of the high pressure water line 164. The control valve 166 includes a valve body 168 and a pneumatic actuator 170 and is connected to a pneumatic switch line 172. The valve 166 may be mounted to and supported by the vertical member 42 on a control valve bracket 174. A suitable pneumatic high pressure valve 166 may be represented by commercially available model 214, part C2728, manufactured by Flow International Corp. of Kent, Wash.

Referring to FIG. 6 and 7, a trunnion axis rotator motor 178 is mounted on the rotator side 68 of the fork 66. The rotator motor 178 is a pneumatic and is operably connected to the trunnions 114 on each side of the front housing 75. A representative motor 178 may be one of the 196 series motors, manufactured by Bimba Manufacturing Co. of Monee, Ill. Pneumatic lines 177 are suitably connected to the rotator motor 178 and to a source of pressurized air (not shown). Further reference to FIGS. 6 and 7 shows a limit stop body 180 mounted on the fork 66. A pair of bilateral mounting limiting fingers 182 are mounted on the front housing 75 and include a vertical travel limit screw 184. An adjustment screw 185 is connected through the body 180 to contact the fingers 182.

All "plumbing" fittings and joints are selected for high pressure air and water usage and, unless specifically noted, are conventional commercially available fittings and connections.

Figure 8:
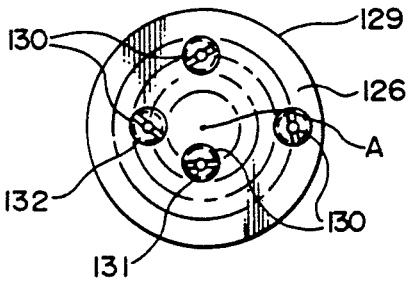
FIG. 8 is a fragmentary elevational view of the discharge end of the nozzle of the present invention.

FIG. 8 is a front elevational view of the discharge end 129 of the nozzle body 126. The outlet orifices 130, four are shown, but there may be any number, are located or offset at different distances from the central axis A of the nozzle body 126. The multiple orifices 130 are countersunk bores having a central axis generally coincident with the central axis of the longitudinally extending bores 132 through the nozzle body 126. Each orifice 130 receives an orifice fitting 131, a drilled socket head cap screw. Alternatively, a plug 132 may be fitted in any one or more of the orifices 130.

With reference to FIG. 1, in use a workpiece W is fixed on the turntable 14. Depending on the nature of the workpiece W and the task, the operational parameters of the apparatus 10 of the present invention may be programmed into or selected from among available parameters in the controller or computer controller memory. The operational parameters possible with the present invention 10 include the following presented in tabular form for clarity:

| Parameter | Parameter Range | Preferred Value |
|---|---|---|
| water pressure | 25,000–55,000 psi | 35,000 psi |
| stand-off distance | .25–3 inches | .25–2.0 inches |
| angle of incidence | 0–90° | 4–15° |
| nozzle rotation speed | 600–700 rpm | 600–650 rpm |
| turntable rotation speed | 6–10 rpm | approx. 8 rpm |
| nozzle traversing speed | 1.5–6 ipm | 1.5 ipm |
| nozzle jet diameter | .003–.006 inch | .006 inch |

A set of preferred values are shown above. It should be appreciated that the above preferred operational parameters may be selected from or varied through the entire parameters range depending upon the particular workpiece or jet engine component being treated. By way of an example, to use the high pressure blasting apparatus 10 of the present invention to remove plasma sprayed coatings from diffuser case flanges, the following stripping parameters might be programmed into the controller: water pressure 35,000 psi; nozzle jet diameter 0.006 inch; part (turntable rotation) 8.0 rpm minimum; nozzle standoff distance 0.15 inches minimum; nozzle rotation 650 rpm minimum; three operational orifices, one being plugged; number of passes 24 maximum.

Figure 2:
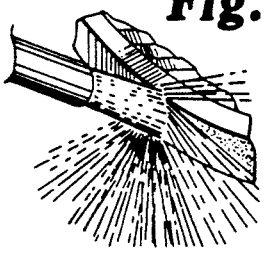
FIG. 2 is a fragmentary detail of the present invention depicting the spray produced by the nozzle of the present invention directed against a workpiece.
Figure 4:
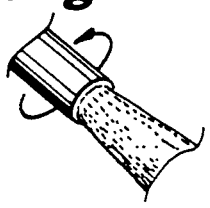
FIG. 4 is a front elevational view of the nozzle body of the present invention showing the orientation of the multiple orifices of the nozzle body.

After appropriate operational parameters are selected, gross manual or mechanical adjustments, such as positioning the nozzle body 126 with respect to the workpiece W may be carried out by moving the water delivery means 18 as desired along the X, Y, Z axes depicted in FIG. 1. The angle of incidence of the stream of water, depicted in FIGS. 2 and 4, may be adjusted by varying the pitch from horizontal of the turntable 14 and by operating the rotator motor 178. The enclosed chamber is cleared of personnel and diagnostic testing may be carried out to determine that the operational parameters are correctly set. Computer control operations may then be initiated and the apparatus 10 will proceed to cycle according to the program.

Figure 9:
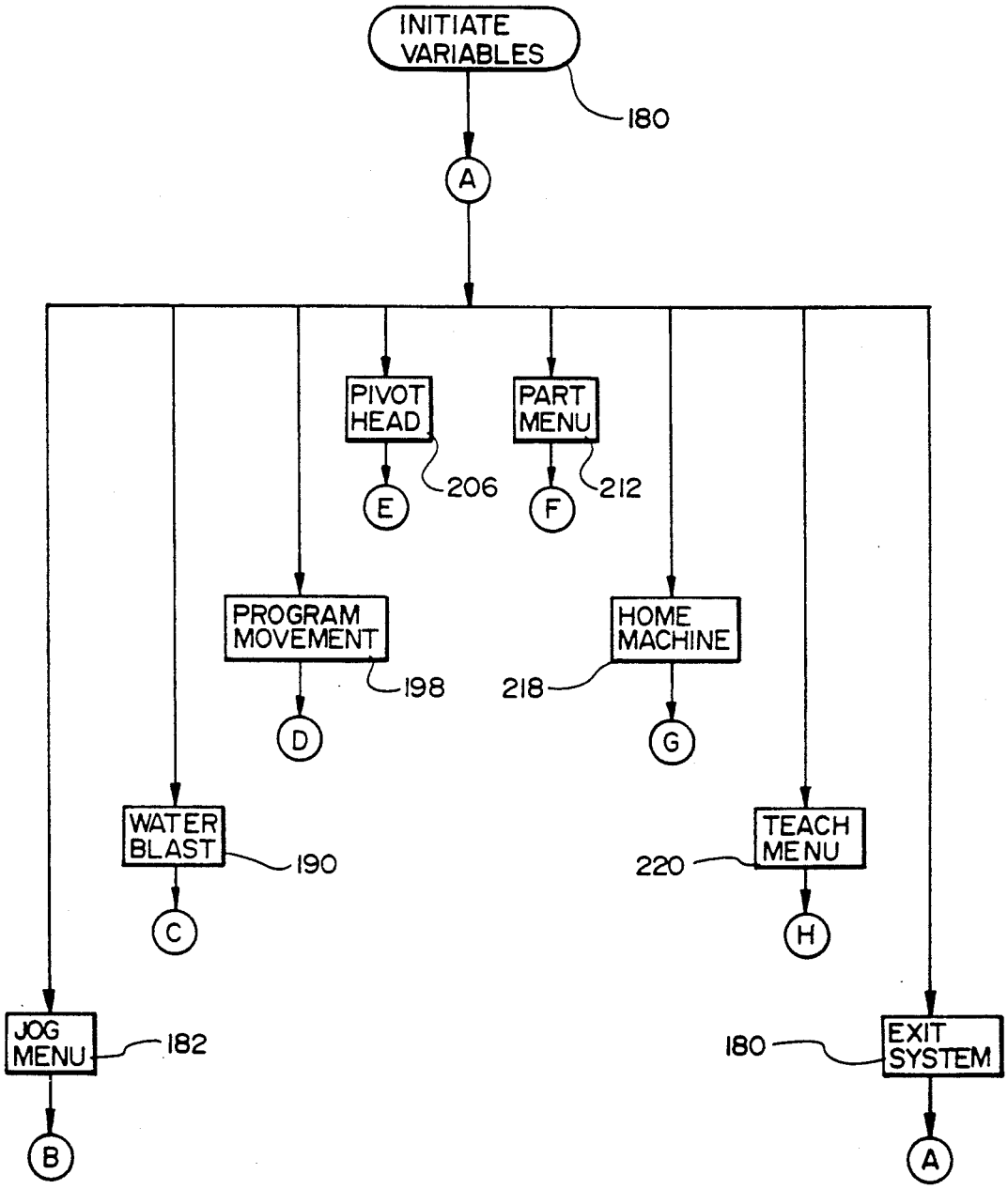
FIGS. 9 and **9*a*–9*h*** are interrelated portions of a flow chart for implementing the data processing method for controlling and operating the water blasting apparatus of the present invention.
Figures 1, 9B:
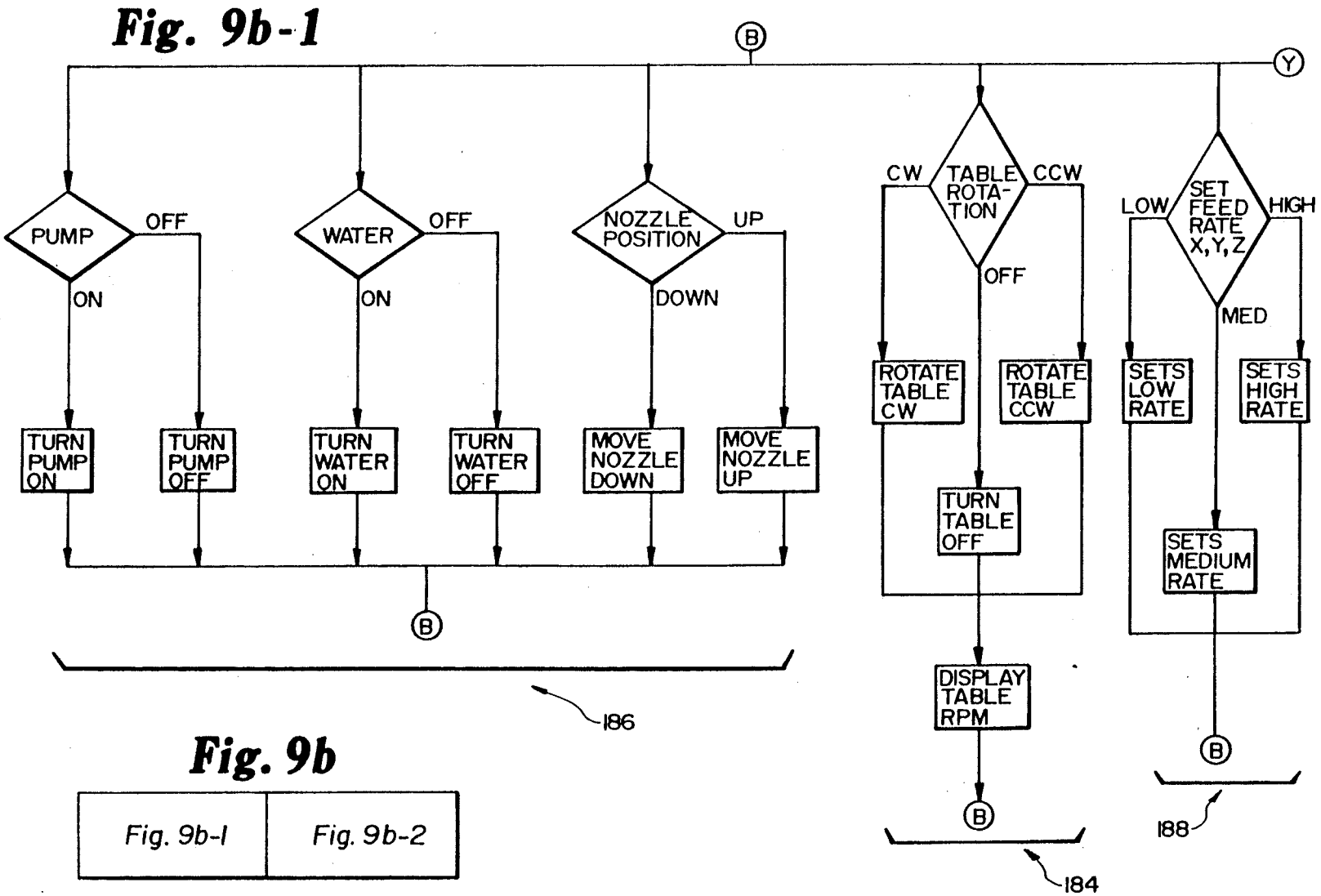
Figures 2, 9B:
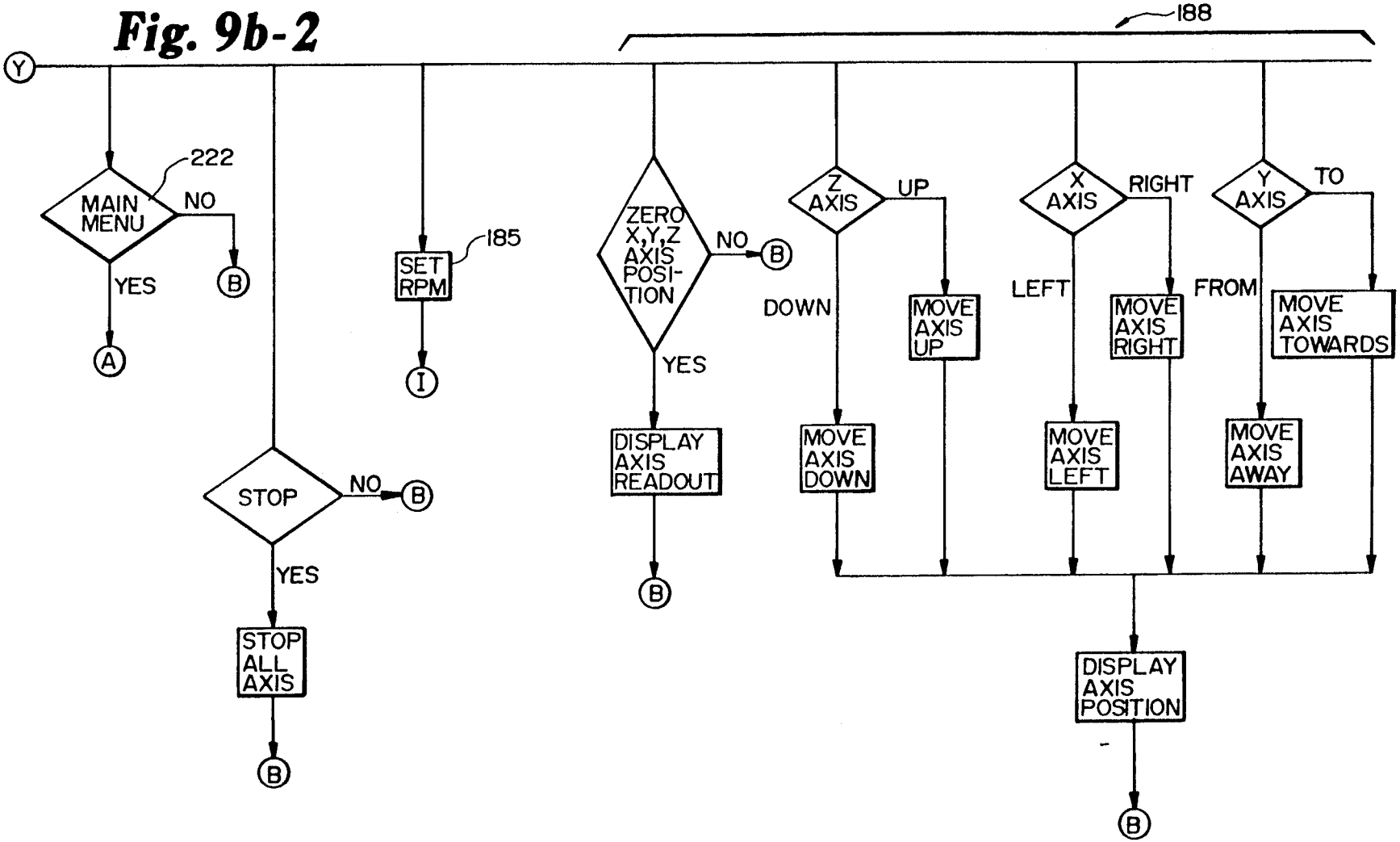
Figures 1, 9D:
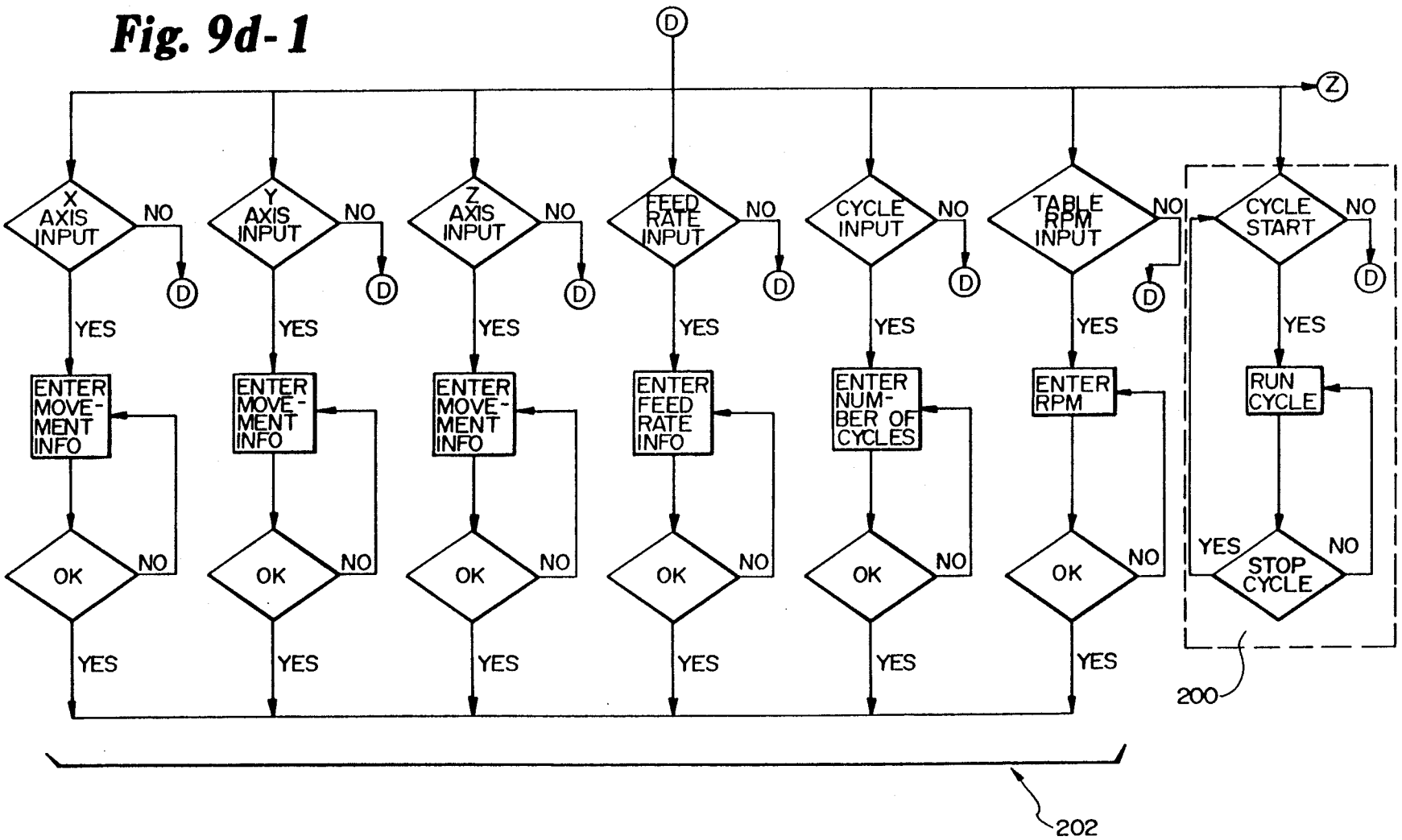
Figures 1, 2, 9D:
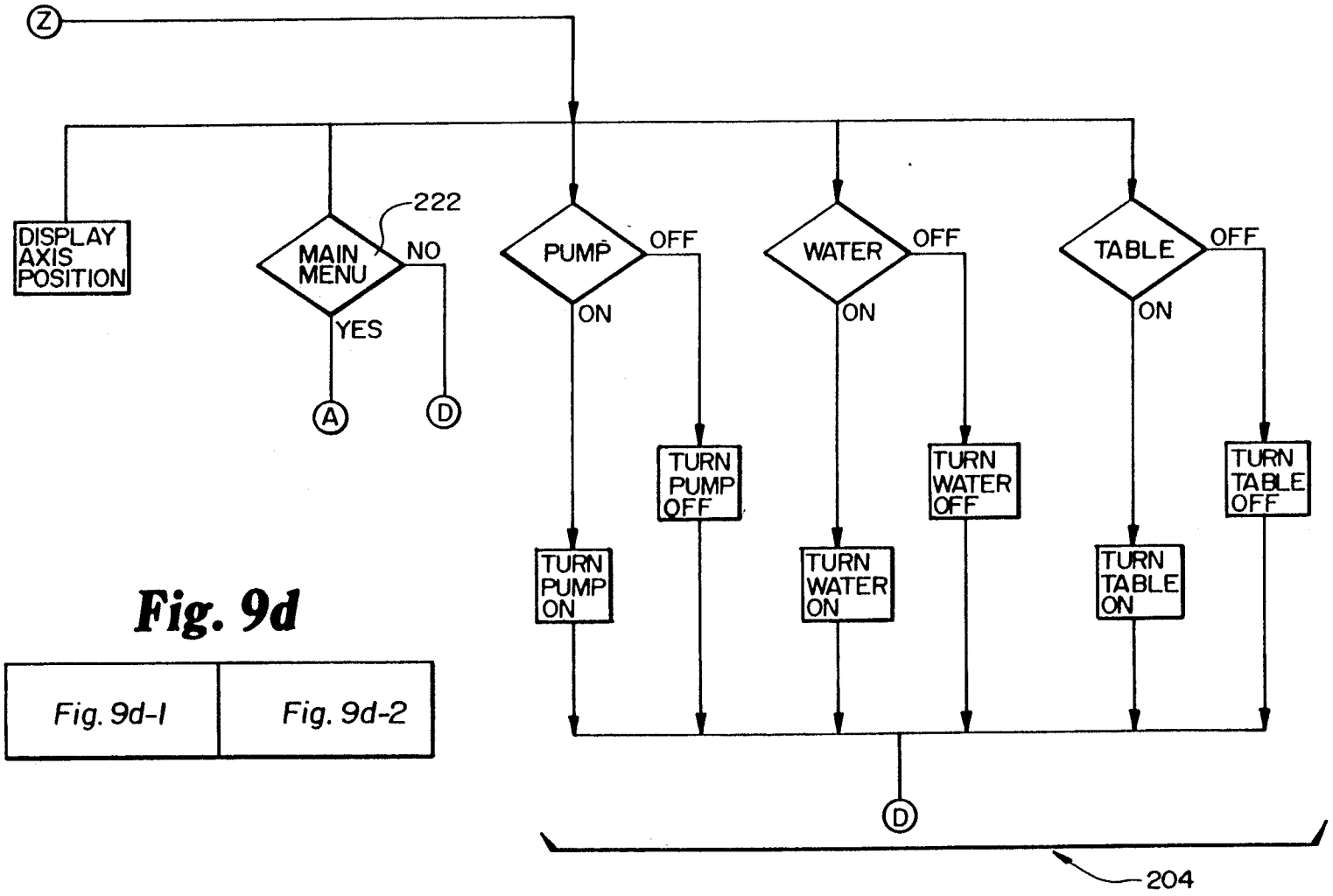
Figure 9C:
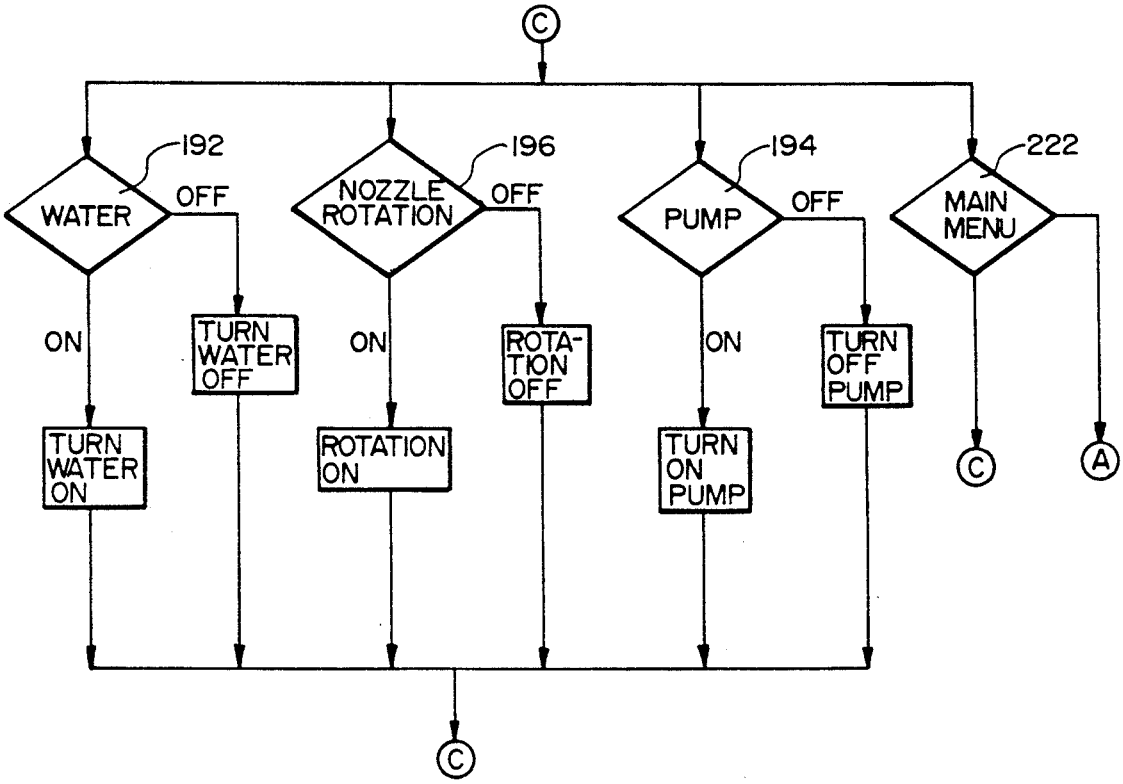
Figure 9E:
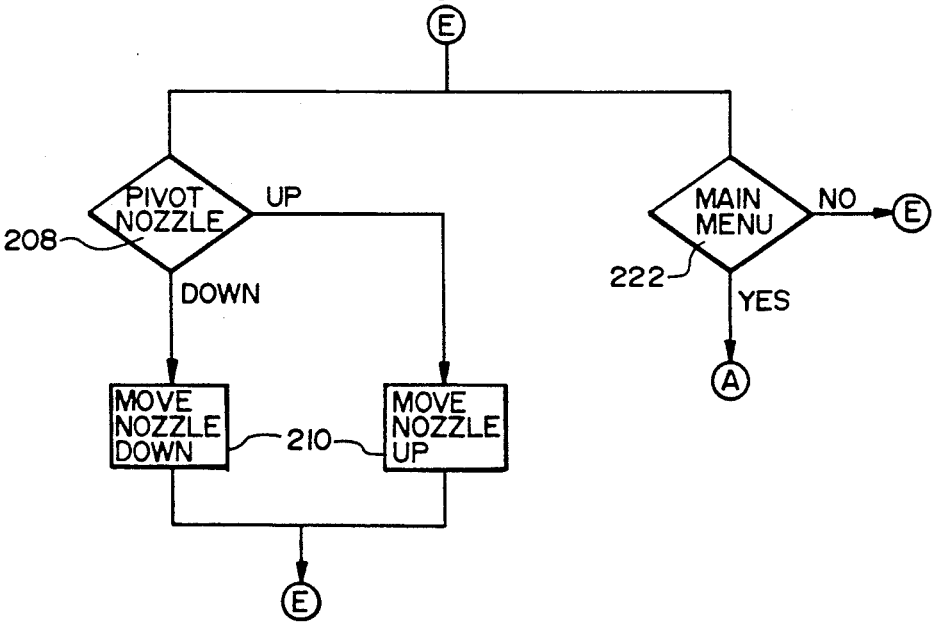
Figure 9F:
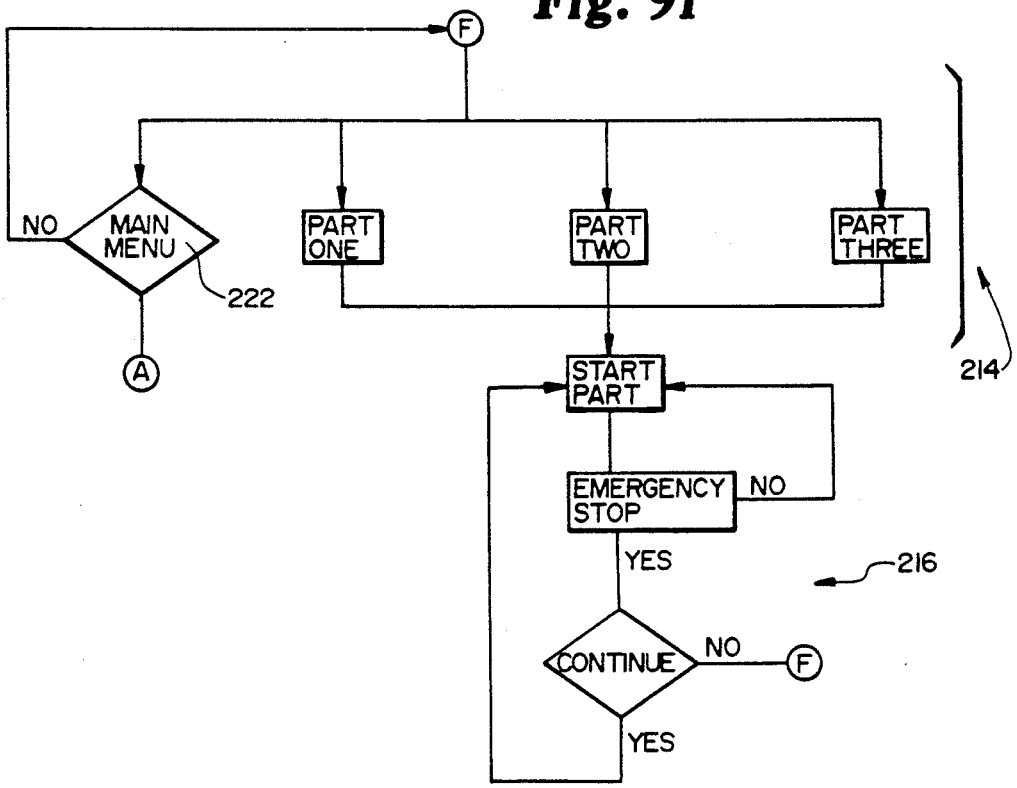
Figure 9G:
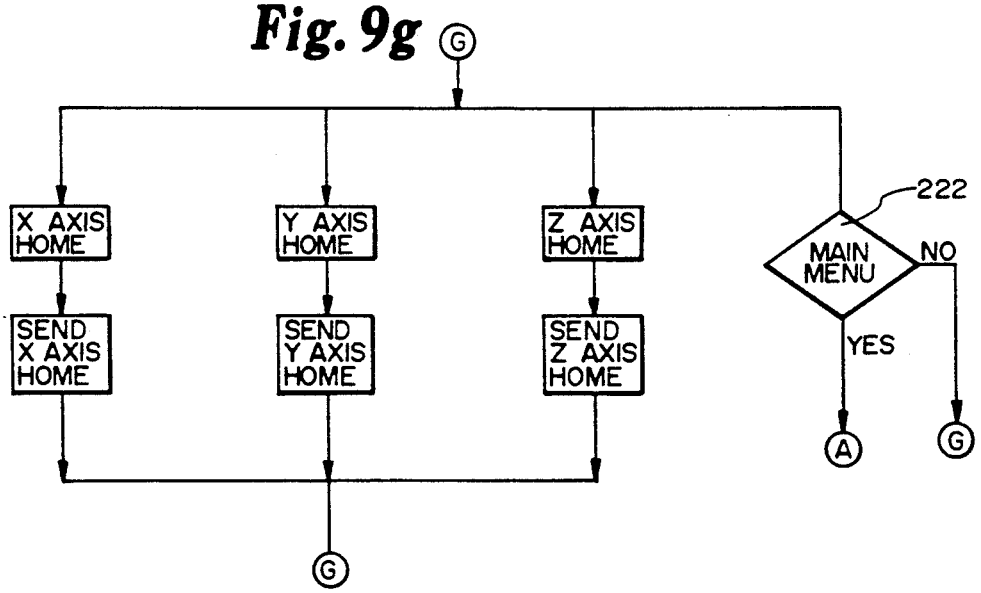
Figure 9H:
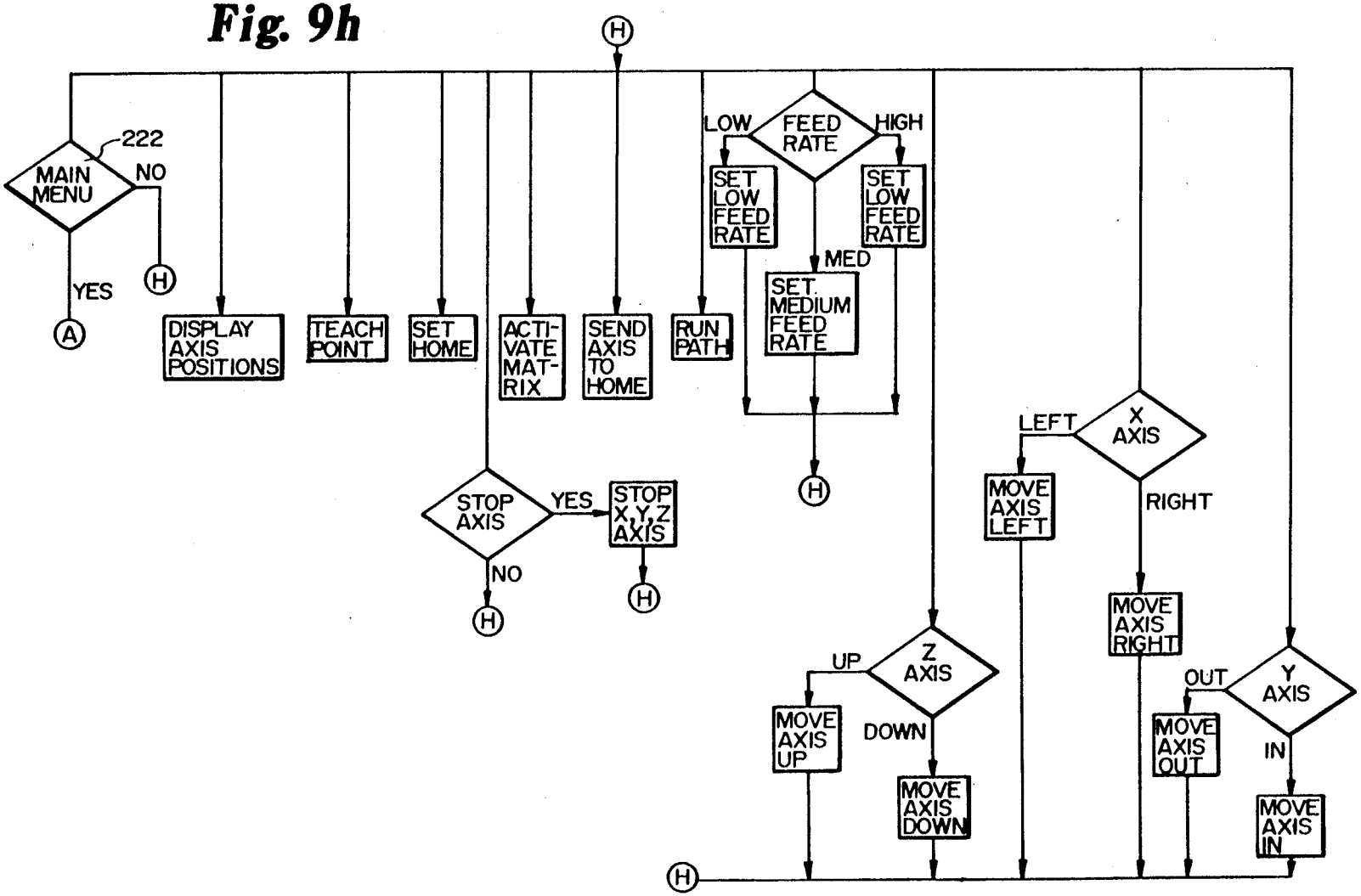
Figure 9I:
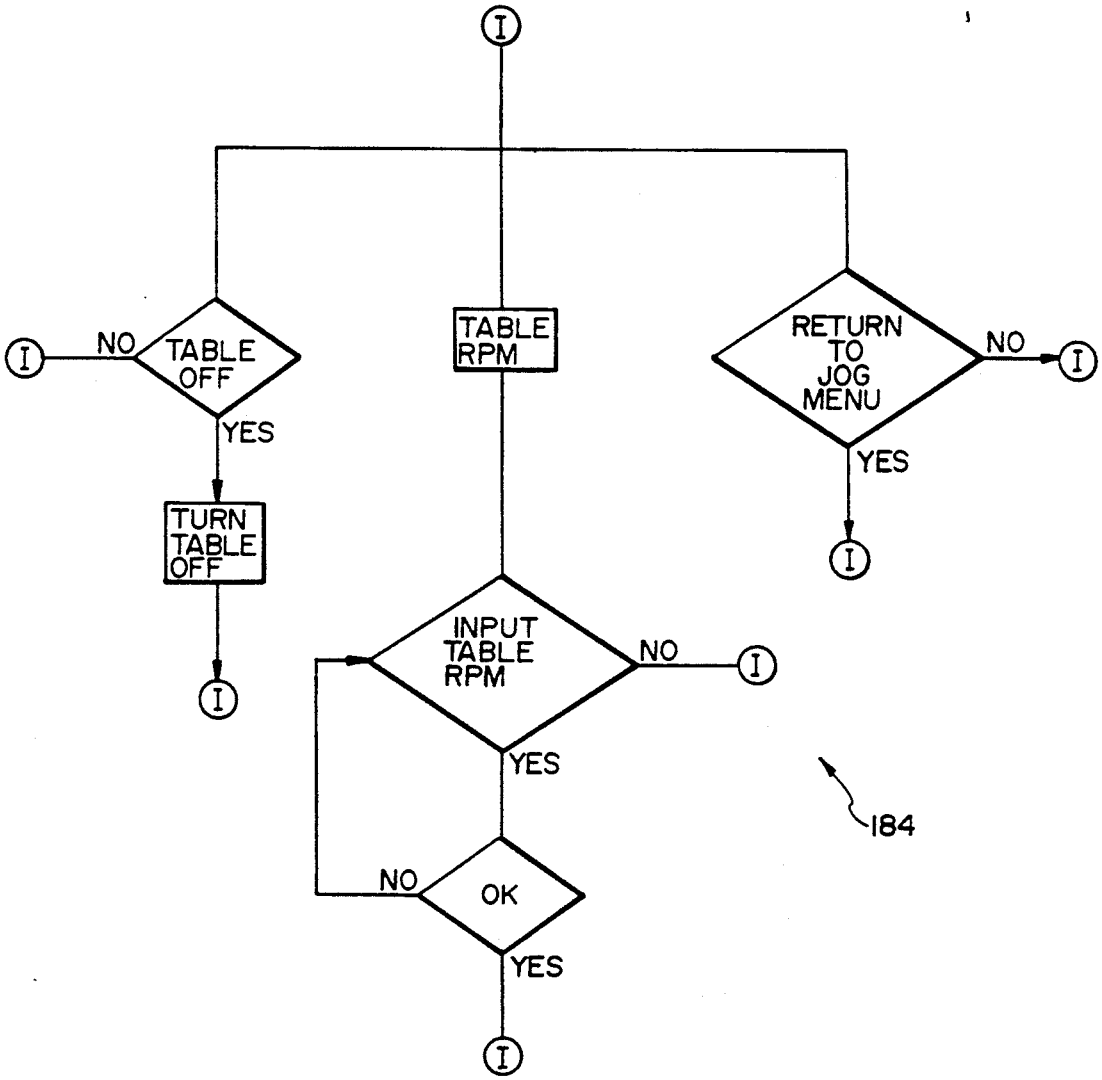

Referring to FIG. 9 and **9*b* through 9*i*, a typical program flow is depicted. Function 180 initilizes variables and constants and represents entry into or exit from the program. Jog menu function 182, depicted in FIG. 9 and with additional details depicted in FIG. 9*b*, involves the selection, verification and display of positional operational parameters, and include turntable rotation and rotation rate function and decision section 184 (also depicted in FIG. 9*a*), waterflow and nozzle body section 186, and movement section 188 relative to the movement of the gantry carriage, dual axis carriage and vertical member 34, 40, 42 along the X, Y and Z axes. Water blast control function 190, depicted in FIG. 9 and 9*c*, includes decisions 192, 194 relating to high pressure water flow, and decision 196 for starting and stopping the nozzle rotation. Program movement control function 198, depicted in FIG. 9 and 9*d*, includes that start, run and stop cycle functions, indicated at 200, and general movement functions and decisions at 202. The movement function 198 also includes a water blast control section 204. Pivot head function 206, depicted in FIG. 9 and 9***e*, includes nozzle position decisions and functions 208, 210, respectively. Part menu function 212, depicted in FIG. 9 and 9*f*, enables program cycling of a selected workpiece contour at sections 214 and includes emergency stop section 216. Home position functions 218, depicted in FIG. 9 and 9*g*, direct the gantry carriage 34, dual axis carriage 40, and vertical member 42 to home position. The teach function 220, depicted in FIG. 9 and 9*h*, provides access for changing or selecting positional operational parameters and for teaching new workpiece information to the program part menu 212. Each of the program functions depicted in FIG. 9 includes a return to main menu decision 222.

At the conclusion of operations, or while the operations are going on, the drain/filtration system 20 may be operative to drain and filter the blastant water and remove the detritus or coating pieces prior to reuse of the water.

It should be appreciated that the apparatus 10 and method of the present invention offer significant improvements over existing chemical and entrained particulate coating removal and treatment methods. The advantages includes faster, safer removal of coatings with no damage to or removal of substrate or parent metal. Use of acids, other corrosives or entrained abrasive particulate matter is eliminated. The present invention has applications in the area of machining, cleaning and material removal, including the removal of engine operation residues, and plasma spray coatings or thermal barrier coatings.

What is claimed is:

1. A method for treating jet engine components coated with a coating selected from a group consisting of ceramic and metallic, coatings with high pressure water using a water blasting apparatus having variable operational parameters, said apparatus including a sealable enclosure, a rotatable workpiece support, and a spinable nozzle with multiple water emitting orifices, said nozzle spaced from, at an angle relative to and movable relative to said component, said method comprising the steps of: isolating in said enclosure the jet engine component to be treated; selecting the operational parameters of the apparatus;

testing the selected operational parameters;

operating the apparatus, including spinning said spinable nozzle as said water emitting orifices emit a stream of high pressure water at a pressure of between 25,000 to 55,000 pounds per square inch, whereby, within said operational parameters, a stream of high pressure water strikes said jet engine component removing said coating from the component without eroding the component.

2. The method according to claim 1, wherein said operational parameters include a water pressure, a stand-off distance between said nozzle and said engine component, an engine component rotation speed, an angle of incidence of said water on said engine component, a nozzle rotation speed, and a component traversing nozzle speed and a nozzle orifice diameter, said parameters comprising:

a stand-off distance range of 0.25–3.0 inches;

an angle of incidence range of 0°–90°;

an nozzle rotation speed range of 600–700 rpm;

engine component rotational speed range of 6–10 rpm;

a component traversing nozzle speed range of 1.5–6.0 ipm; and a nozzle orifice diameter range of 0.300–0.006 inch.

3. The method according to claim 1, wherein said operational parameters include a water pressure, a stand-off distance between said nozzle and said engine component, an engine component rotation speed, an angle of incidence of said water on said engine component, a nozzle rotation speed, a component traversing nozzle speed and a nozzle orifice diameter, said parameters further comprising;

a water pressure of 35,000 psi;

a stand-off distance of 0.5 inch;

an angle of incidence of 4°–15°;

an nozzle rotation speed of 650 rpm;

engine component rotational speed of 8 rpm;

a component traversing nozzle speed of 1.5 ipm; and a nozzle orifice diameter of 0.006 inch.

* * * * *

UNITED STATES PATENT AND TRADEMARK OFFICE

CERTIFICATE OF CORRECTION

PATENT NO. : 5,167,720

DATED : December 1, 1993

INVENTOR(S) : Edward M. Diamond, et. al.

It is certified that error appears in the above-indentified patent and that said Letters Patent is hereby In column 4, line 9, delete the word "an" and insert --a--.

In column 5, line 20, delete the word "inputting" and insert the word --input--.

In column 5, line 21, delete, the word "an" and insert --a--.

In column 6, line 23, delete the word "parameters" and insert the word --parameter--.

In column 6, line 55, add an "s" to the end of the word include.

In column 6, line 57, delete "9a" and insert --9i--.

In column 7, line 24, add an "s" to the end of the word include.

In column 7, line 36, after metallic delete --,--.

In column 7, line 40, delete the word "spinable" and insert the word --spinnable--.

In column 8, line 5, delete the word "spinable" and insert the word --spinnable--.

In column 8, line 22, delete the word "an" and insert --a--.

In column 8, line 27, delete "0.300" and insert --0.003--.

UNITED STATES PATENT AND TRADEMARK OFFICE

CERTIFICATE OF CORRECTION

PATENT NO. : 5,167,720

DATED : December 1, 1993

INVENTOR(S) : Edward M. Diamond, et. al.

It is certified that error appears in the above-indentified patent and that said Letters Patent is hereby corrected as shown below:

In column 8, line 39, delete the word "an" and insert --a--.

Signed and Sealed this

Ninth Day of August, 1994

*Attest:*

Bruce Lehman

BRUCE LEHMAN

*Attesting Officer*

*Commissioner of Patents and Trademarks*